United States Patent [19]

Cirket et al.

[11] Patent Number: 4,918,790

[45] Date of Patent: Apr. 24, 1990

[54] CAM BUCKLE

[75] Inventors: Morgan T. Cirket, San Diego; Michael J. Duly, Chula Vista, both of Calif.

[73] Assignee: Soniform, Inc., El Cajon, Calif.

[21] Appl. No.: 351,862

[22] Filed: May 12, 1989

[51] Int. Cl.[5] ..... A44B 21/00

[52] U.S. Cl. ..... 24/71 R; 24/68 CD; 24/71 ST; 24/442

[58] Field of Search ..... 24/71 R, 71 T, 71 ST, 24/71 A, 68 CD

[56] References Cited

U.S. PATENT DOCUMENTS

| | | | |
|---|---|---|---|
| 398,714 | 2/1889 | Farr | 24/71 TD |
| 1,084.057 | 1/1914 | Avelsgard | 24/71 ST |
| 2,901,794 | 9/1959 | Prete, Jr. | 24/170 |
| 3,262,169 | 7/1966 | Jantzen . | |
| 3,343,229 | 9/1967 | Tanaka . | |
| 3,413,691 | 12/1968 | Elsner . | |
| 3,496,615 | 2/1970 | Krengel . | |
| 3,574,246 | 4/1971 | Norton | 24/68 CD |
| 3,574,342 | 4/1971 | Berns | 24/68 CD |
| 3,608,158 | 9/1971 | Bengtsson . | |
| 3,678,542 | 7/1972 | Prete, Jr. . | |
| 3,686,715 | 8/1972 | Brodnicki | 24/68 CD |
| 3,798,711 | 3/1974 | Cousins . | |
| 4,035,877 | 7/1977 | Brownson . | |
| 4,150,464 | 4/1979 | Tracy . | |
| 4,171,555 | 10/1979 | Bakker . | |
| 4,273,130 | 6/1981 | Simpson | 24/442 |
| 4,528,700 | 7/1985 | Johnston . | |
| 4,796,336 | 1/1989 | Scully | 24/68 CD |

FOREIGN PATENT DOCUMENTS

| | | |
|---|---|---|
| 970611 | 9/1964 | United Kingdom . |

*Primary Examiner*—Victor N. Sakran

[57] ABSTRACT

A cam buckle for adjustably securing a strip of web-like material includes a pair of side walls having front and rear ends, a top wall extending between the side walls, a first bar extending between the side walls below the top wall and a second bar slidably mounted between the first bar and the top wall. A loop is pivotally attached to the side walls rearwardly of the second bar, and one end of the strip is secured to the loop. The buckle is pivotable relative to the loop between locked and unlocked positions. The other end of the strip is looped around the second bar when the buckle is in the unlocked position, and the end of the strip is secured to the remainder of the strip by hook and loop fasteners. The buckle may be cammed over center to the locked position to tighten the strip.

8 Claims, 4 Drawing Sheets

FIG. 1
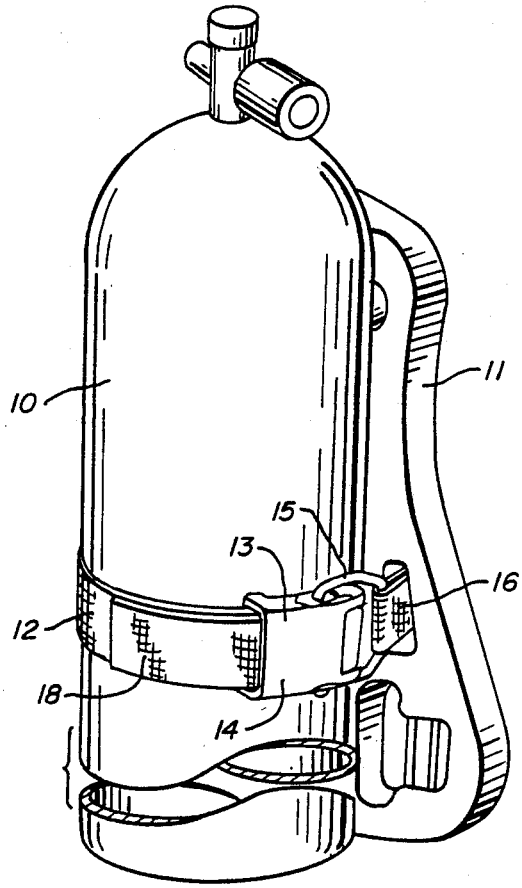
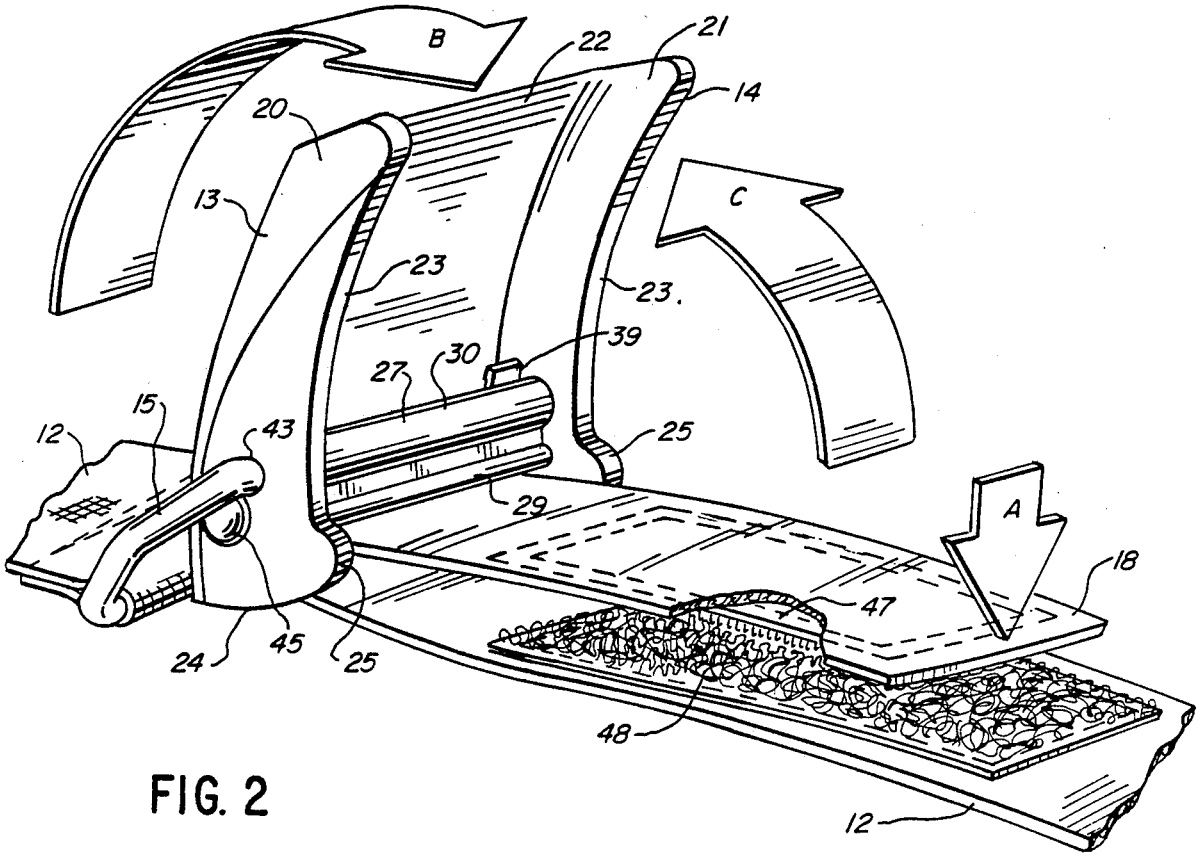
FIG. 2

FIG. 3
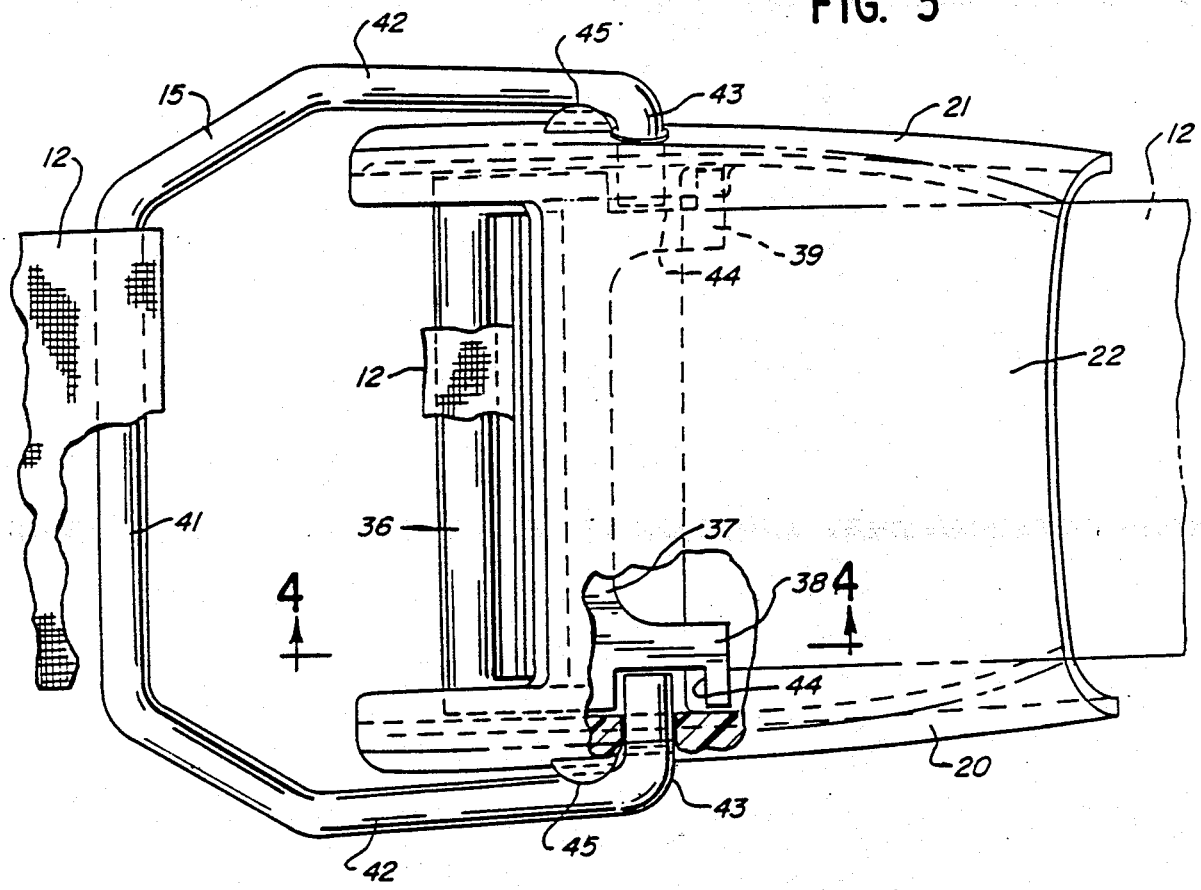
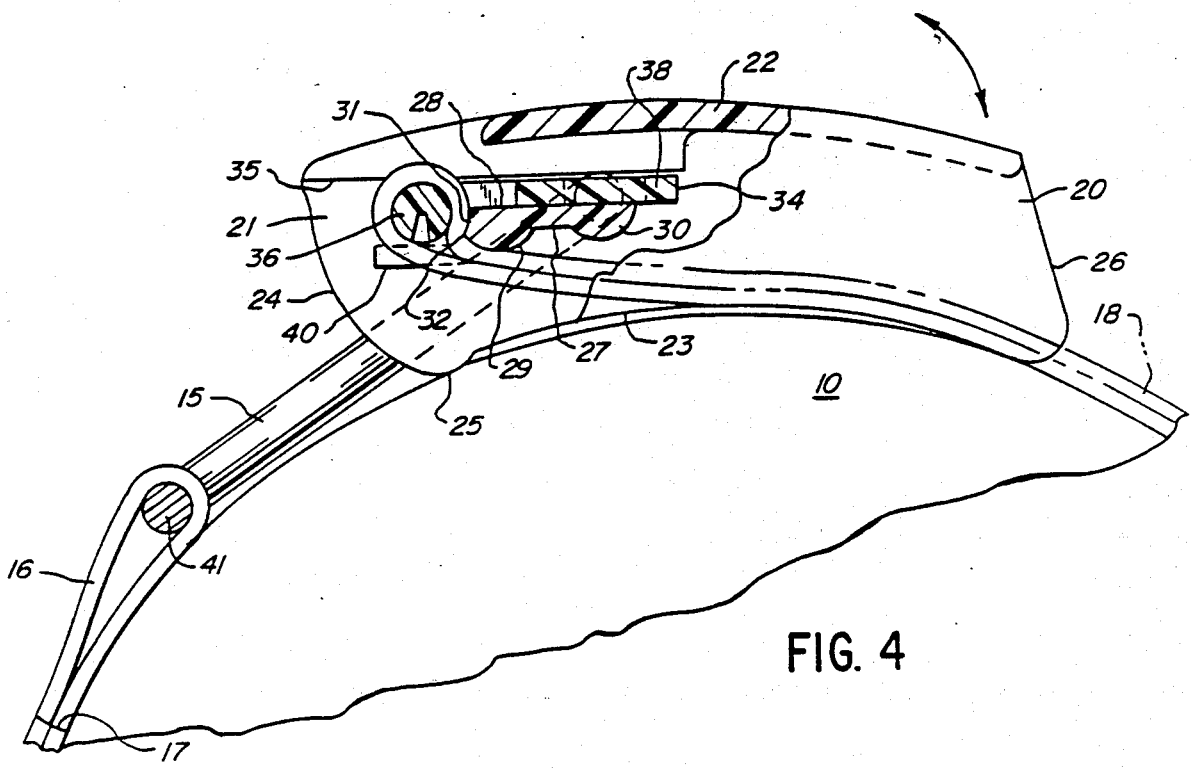
FIG. 4

CAM BUCKLE

BACKGROUND AND SUMMARY

This invention relates to a cam buckle for tightening the ends of a web or strap, and, more particularly, to a cam buckle with a sliding bar for pinching the web as the cam buckle is locked. The buckle may be provided with a second slot for webbing to pass through for securing the buckle and providing added safety.

The invention finds particular utility in releasably securing a scuba tank to a backpack, either soft or rigid, which is worn by a scuba diver. Scuba tanks are commonly secured by a strip of web-like material such as nylon belting. One end of the web is attached to a buckle, and the web is wrapped around the tank. The other end of the web is threaded through the buckle, and the tank is secured by closing the buckle to tighten the web about the tank. Some systems use four webs which are attached to a flexible wrap or backpack. Two of these webs hold buckles in fixed locations, and the other webs are passed through the buckles for attaching the scuba tank in a sling with two straps. This is known as a soft pack.

Conventional buckles generally require a complicated web-threading routine. If the web is not threaded properly, the tank can be lost. Also, when the buckle is unlocked to allow changing the tank, the position of the web often has to be readjusted before the buckle is locked again.

The invention provides an over-center cam buckle which greatly simplifies threading the web through the buckle. The buckle includes a pair of side walls and a first bar which extends between the side walls. A second bar is slidably mounted between the side walls adjacent the first bar. A loop is pivotally attached to the side walls rearwardly of the second bar. The buckle is pivotable about camming surfaces provided by the side walls between a locked position in which the pivotable attachment of the loop moves over center rearwardly of the second bar, and an unlocked position in which the pivotable attachment is above the second bar. One end of a web is secured to the loop, and the other end of the web is threaded around the second bar when the buckle is unlocked and secured to the web by hook and loop fasteners. When the buckle moves to the locked position, the second bar slides toward the first bar and pinches the web therebetween.

DESCRIPTION OF THE DRAWING

The invention will be explained in conjunction with an illustrative embodiment shown in the accompanying drawing, in which FIG. 1 is a perspective view of a scuba tank secured by a buckle which is formed in accordance with the invention;

FIG. 2 is an enlarged fragmentary perspective view of the buckle and the web;

FIG. 3 is a top plan view, partially broken away, of the buckle and the web;

FIG. 4 is a side elevational view, partially broken away, showing the buckle in a locked position against the tank;

DESCRIPTION OF SPECIFIC EMBODIMENT

Figure 5:
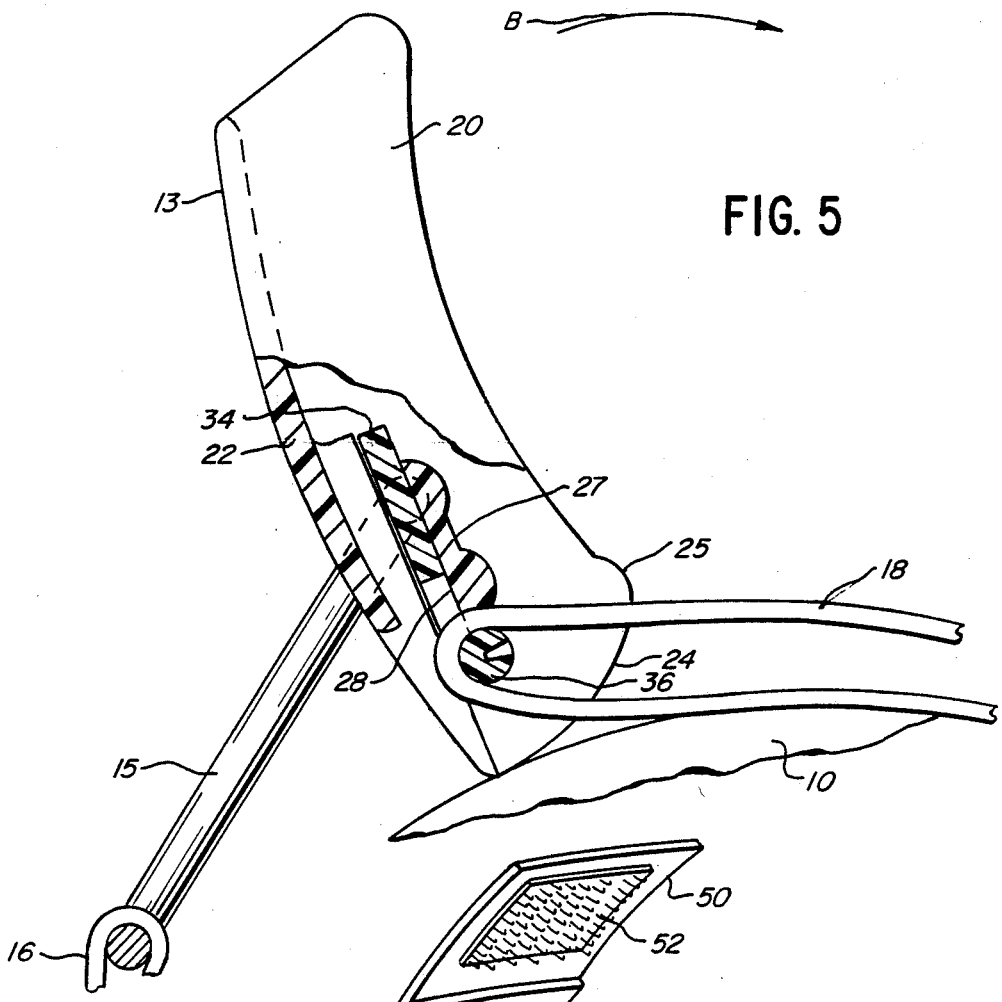
FIG. 5 is a view similar to FIG. 2 showing a modified embodiment of the buckle.

Referring to FIG. 1, a scuba air tank 10 is removably secured to a backpack frame 11 by a web or strap 12 and a cam buckle 13. The backpack 11 may be attached to a scuba diver in the conventional manner by straps, a shoulder harness, etc. Although the invention will be explained in conjunction with a scuba tank, it will be understood that the buckle can be used for securing other objects.

The buckle 13 includes a molded plastic frame 14 and a metal loop or C-ring 15 which is pivotally attached to the frame. The web 12 may be made from any suitable material, for example, nylon belting. One end 16 of the web is looped around the loop 15 and secured by stitching 17 (FIG. 4). The web extends around the backpack and the tank, and the other end 18 of the web is threaded through the buckle as will be explained hereinafter. The web is secured as the buckle is cammed into its locking position illustrated in FIG. 1.

Referring to FIGS. 2–4, the frame 14 of the buckle includes a pair of parallel side walls 20 and 21 and a top wall 22 which extends between the side walls. Each of the side walls has a curved bottom edge 23 which conforms generally to the contour of the tank 10, a curved front camming edge 24 which terminates in a downwardly extending projection 25 which extends below the bottom edge 23, and a rear edge 26.

A bar 27 extends between the side walls 20 and 21 and is molded integrally therewith. The bar includes a flat top surface 28 and a pair of rounded reinforced ribs 29 and 30. The front of the bar 27 has a downwardly and forwardly slanted flat surface 31 which provides a sharp edge 32.

A molded plastic slide 34 is slidably mounted between the flat top surface 28 of the bar 27 and a pair of shoulders 35 which extend laterally outwardly from the side walls 20 and 21. The slide 34 includes a round front bar 36, a flat rear bar 37, and a pair of side arms 38 and 39 (FIG. 3) which extend between the front and rear bars. The thickness of the side arms 38 and 39 is slightly less than the spacing between the flat surface 28 and the shoulders 35, and the side arms slidably mount the slide 34 between the surface 28 and the shoulders 35. The round bar 36 is also slidably supported by a pair of shoulders 40 which are molded with the side walls 20 and 21 and which extend laterally inwardly. If desired, the bar 36 can be reinforced by a metal rod.

The C-ring 15 includes a front portion 41, a pair of side portions 42, and a pair of laterally inwardly extending end portions 43 which are pivotally mounted in openings in the side walls 20 and 21. The end portions extend into recesses 44 in the side arms 38 and 39 of the slide 34. The recesses permit limited sliding movement of the slide, but the end portions 43 of the C-ring are engageable with the ends of the recesses to prevent the slide from being withdrawn from between the flat surface and the shoulders 35.

A pair of spherical detent projections 45 extend outwardly from the side walls 20 and 21 and are engageable with the side portions 42 of the C-ring. The detents 45 releasably retain the C-ring in the locked position illustrated in FIGS. 3 and 4. When the buckle is pivoted to its unlocked position illustrated in FIG. 2, the detents 45 force the side portions 42 and end portions 43 of the C-ring outwardly as the side portions move over the detents. The C-ring is made from resilient metal so that the C-ring returns to its unstressed position after it passes the detents.

When the buckle is unlocked as shown in FIG. 2, the end 18 of the web 12 is threaded through the buckle by passing the end portion around the bar 36 on the slide 34 and through the space between the bar 36 and the stationary bar 27. Hook and loop fasteners 47 and 48 of the type sold under the trademark Velcro are attached to the end 18 and to an intermediate portion of the web. While the buckle is maintained in a position in which the camming edges 24 of the side walls engage the tank and the side walls and top wall of the buckle are generally aligned with a diameter of the tank, the web is pulled around the bar 36 to tighten the web and to pull the tank 10 snugly against the backpack 11. The end 18 of the web is then secured by pressing the fasteners 47 and 48 together as indicated by the arrow A in FIG. 2. The length of the web is thereby adjusted and maintained by the fasteners.

The web is then further tightened around the tank 10 and the backpack 11 to clamp the tank securely against the backpack by pivoting the buckle to its locked position as indicated by the arrow B. When the buckle is in the unlocked position in FIG. 2, the pivoted ends 43 of the C-ring 15 are positioned above the bar 36 around which the web is looped and the curved front camming edges 24 of the buckle engage the tank 10. As the buckle rotates toward its locked position illustrated in FIG. 4, the camming edges 24 roll over the tank 10, and the pivoted ends 43 of the C-ring move to the right of the bar 36 as viewed in FIG. 4 to reduce the effective length of the web, i.e., the length of the web from the pivoted ends 43 of the C-ring to the bar 36. The web is therefore tightened about the tank and the backpack. The curvature of the camming edges 24 relative to the positions of the pivoted ends 43 and the bar 36 is such that just before the buckle reaches its locked position, the pivoted ends 43 pass over center with respect to the bar 36 and increase the effective length of the web. The over-center position of the C-ring retains the buckle in its locked position because a tightening force must be exerted on the web to move the buckle out of its locked position. The side portions 42 of the C-ring pass over the detents 45 just before the buckle reaches its locked position, and the detents provide an additional force for retaining the buckle in its locked position.

As the buckle tightens the web, the sliding bar 36 will be pulled by the web toward the stationary bar 27, and the web will be pinched between the bar 36 and the sharp edge 32 of the stationary bar 27. The pinching action ensures that the adjusted length of the web will be retailed even if the end fasteners 47 and 48 are not used.

The buckle is unlocked by pivoting the buckle as indicated by the arrow C in FIG. 2. The top wall 22 of the buckle provides a convenient handle for pivoting the buckle in either direction. When the buckle is unlocked, the web is loosened sufficiently to permit the tank 10 to slide out of the looped web without unfastening the end 18 of the web. The adjusted length of the web which is provided by the fasteners 47 and 48 is thereby retained as the tank is removed and a new tank is inserted. The new tank can be secured simply by pivoting the buckle to its locked position without readjusting the web tension.

Figure 6:
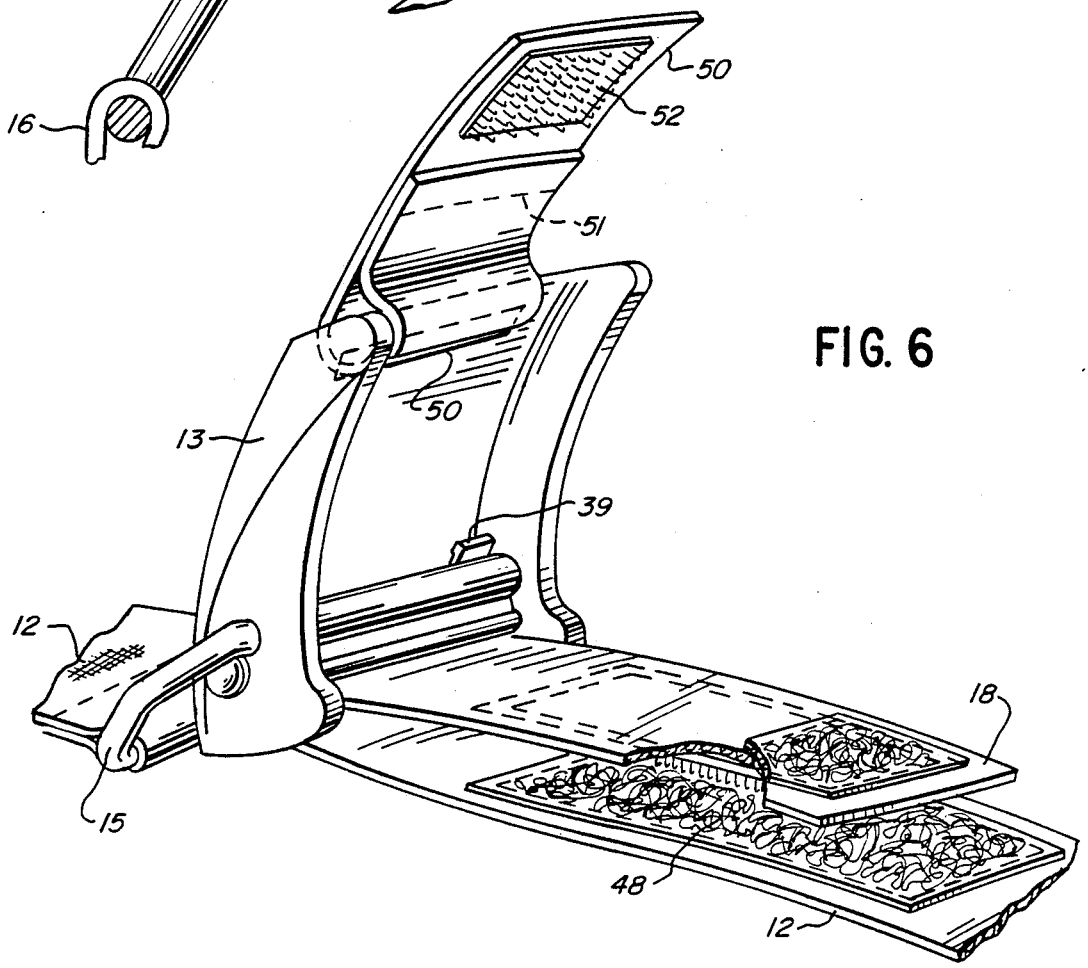
FIG. 6 is a view similar to FIG. 2 showing a modified embodiment of the buckle.

FIG. 6 illustrates a modified embodiment of the buckle. A second web 48 extends through a slot 49 in the rear end of the top wall 22, and the looped end of the web 48 is secured by stitching 50. A pad 51 of a hook and loop fastener which can be attached to the fastener 48 on the web 12 is secured to the web 48. When the buckle has been cammed to its closed position, the fastener 51 can be attached to the fastener 48 as an added safety feature to provide additional means for securing the buckle in its locked position. When the tank is to be removed, the fastener 41 is simply peeled away from the fastener 48, and the buckle is pivoted to its unlocked position as previously described.

Figure 7:
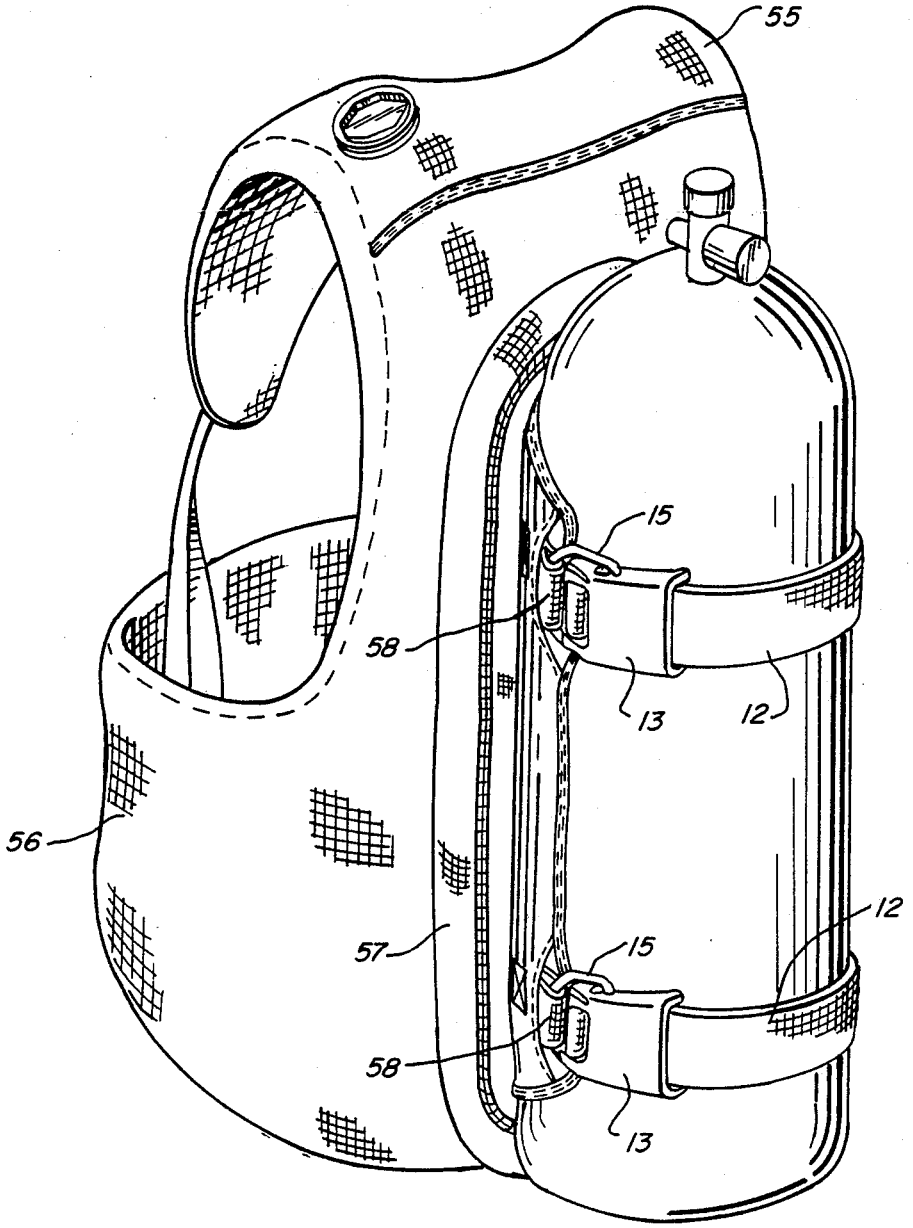
FIG. 7 is a perspective view of a sling type scuba system which includes a soft pack and two buckles.

FIG. 7 illustrates a soft pack buoyancy compensator 55 which includes a vest 56 which is worn by the scuba diver and a sling 57 which is attached to the vest. A pair of buckles 13 are attached to the sling by metal C-rings 15 which are secured to the sling by looped webs 58. A pair of webs 12 are stitched to the other side of the sling and are threaded through the buckles 13 as previously described.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A cam buckle for tightening a strip of web-like material about an article to be secured comprising:

a frame having a pair of side walls with front and rear ends, a loop pivotally attached to said side walls, the loop being adapted for holding one end of said strip of web-like material, a first bar extending between said side walls and attached thereto at a position forwardly of the pivotable attachment of the loop, a second bar mounted on the side walls and extending generally parallel to the first bar, the second bar being adapted for holding the other end of said strip of web-like material, the buckle being movable between an unlocked position in which the front ends engage the article to be secured and the pivotable attachment of the loop is above the second bar and a locked position in which the pivotable attachment of the loop moves rearwardly of the second bar and passes over center relative to the second bar, and said second bar being slidably mounted on said side walls and being slidable toward said first bar when tension is exerted on the strip of web-like material whereby the strip is clamped between the first and second bars.

2. The buckle of claim 1 in which each of the side walls includes a bottom edge and the front ends of the side walls are curved relative to the second bar and the pivotable attachment of the loop to cause the pivotable attachment to pass over center relative to the second bar as the buckle moves from its unlocked position to its locked position, the bottom edges of the side wall being adjacent the article to be secured when the buckle is in its unlocked position.

3. The buckle of claim 1 in which said first bar includes a relatively sharp edge adjacent said second bar for engaging said strip.

4. The buckle of claim 1 including a shoulder mounted on each of said side walls above said first bar, said first bar having a flat surface facing said shoulders, said second bar being slidably supported by the flat surface of said first bar and the shoulders.

5. The buckle of claim 1 in which each of the side walls includes a bottom edge, the front ends of the side walls terminating in a downwardly extending projection which extends below the bottom edges.

6. The buckle of claim 1 including a strip of web-like material having an end portion looped around said second bar, the end portion of the strip and the strip having hook and loop fasteners for adjustably securing the end portion.

7. The buckle of claim 1 including a laterally outwardly extending projection on each of the side walls engageable with the loop for releasably locking the loop in a locked position.

8. The buckle of claim 1 including a strip of web-like material secured to the buckle and fastening means mounted on the strip, the fastening means adapted to be removably fastened to the strip of web-like material which extends around the second bar when the buckle is in its locked position.

* * * * *